US010532592B2

(12) United States Patent
Izawa et al.

(10) Patent No.: US 10,532,592 B2
(45) Date of Patent: Jan. 14, 2020

(54) INKJET RECORDING APPARATUS HEAD POSITION ADJUSTMENT MECHANISM AND LINE HEAD

(71) Applicant: MIYAKOSHI PRINTING MACHINERY CO., LTD., Narashino-shi, Chiba (JP)

(72) Inventors: Hideo Izawa, Narashino (JP); Kouichi Ooyama, Yokote (JP); Ayumu Sasaki, Yokote (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 24 days.

(21) Appl. No.: 15/945,330

(22) Filed: Apr. 4, 2018

(65) Prior Publication Data

US 2019/0210385 A1 Jul. 11, 2019

(30) Foreign Application Priority Data

Jan. 10, 2018 (JP) ..... 2018-002239

(51) Int. Cl.
*B41J 25/00* (2006.01)
*B41J 2/01* (2006.01)
(Continued)

(52) U.S. Cl.
CPC ..... *B41J 25/001* (2013.01); *B41J 2/2146* (2013.01); *B41J 25/34* (2013.01); *B41J 2/01* (2013.01);
(Continued)

(58) Field of Classification Search
CPC ..... B41J 25/001; B41J 2/01
See application file for complete search history.

(56) References Cited

U.S. PATENT DOCUMENTS 8,757,773 B2 6/2014 Shinoda
9,227,444 B1 1/2016 Ben-Noon
(Continued)

FOREIGN PATENT DOCUMENTS

JP 2001-113679 A 4/2001
JP 2005-305920 A 11/2005
(Continued)

OTHER PUBLICATIONS

Extended European Search Report issued in App. No. 18164104.4 dated Oct. 24, 2018 (13 pages).

*Primary Examiner* — Alessandro V Amari
*Assistant Examiner* — Kendrick X Liu
(74) *Attorney, Agent, or Firm* — Flynn Thiel, P.C.

(57) ABSTRACT

A head position adjustment mechanism including: a head fixing section for fixedly supporting a head section; a linear-motion mechanism to which the head fixing section has been attached; and a bracket to which the linear-motion mechanism has been attached, the bracket has a tapered pin attached to the bracket and a plunger attached to the bracket, the tapered pin and the plunger facing each other, the tapered pin has its tapered part brought into contact with a first side end of the head fixing section in the X-axis direction, the plunger biases a second side end of the head fixing section in the X-axis direction toward the tapered pin, and moving up and down the tapered pin causes the head fixing section to linearly move in the X-axis direction so that the position of the head fixing section is adjusted.

25 Claims, 13 Drawing Sheets

(51) Int. Cl.
*B41J 25/34* (2006.01)
*B41J 2/21* (2006.01)

(52) U.S. Cl.
CPC ..... *B41J 2202/14* (2013.01); *B41J 2202/21* (2013.01)

(56) References Cited

U.S. PATENT DOCUMENTS

| | | | | |
|---|---|---|---|---|
| 2002/0126169 | A1* | 9/2002 | Wyngaert | B41J 2/155 347/12 |
| 2006/0170732 | A1* | 8/2006 | Yamada | B41J 2/15 347/49 |
| 2010/0128081 | A1* | 5/2010 | Ito | B41J 2/175 347/19 |
| 2011/0279513 | A1* | 11/2011 | Mizes | B41J 2/17593 347/19 |
| 2012/0206530 | A1 | 8/2012 | Mizes et al. | |
| 2015/0202867 | A1* | 7/2015 | Koga | B41J 2/155 347/14 |

FOREIGN PATENT DOCUMENTS

| | | | |
|---|---|---|---|
| JP | 2008-062534 | A | 3/2008 |
| JP | 2012-161992 | A | 8/2012 |
| JP | 2014-014972 | A | 1/2014 |
| WO | WO2017/109833 | A1 | 6/2017 |

* cited by examiner

INKJET RECORDING APPARATUS HEAD POSITION ADJUSTMENT MECHANISM AND LINE HEAD

TECHNICAL FIELD

The present invention relates to an inkjet recording apparatus head position adjustment mechanisms and line heads and, more specifically, to a head position adjustment mechanism and a line head for adjusting the position of a head section of an inkjet recording apparatus having a plurality of head sections.

BACKGROUND ART

There has been known a so-called inkjet recording apparatus that performs recording on a recording medium by ejecting fine droplets of ink from a plurality of nozzles formed in a head section.

A common inkjet recording apparatus is mounted with a plurality of head sections. This makes it possible to, in a case where a printing defect occurs in a particular position due to nozzle clogging of a head section, replace only the defective head section without replacing all of the head sections. Further, mounting the plurality of head sections in a direction of relative movement of a head section and a recording medium makes it possible to increase the resolution in a main scanning direction without reducing the recording speed or increase the recording speed while maintaining the resolution in the main scanning direction.

Incidentally, since, as mentioned above, a plurality of head sections are used in an inkjet recording apparatus, even a misalignment of one of the head sections, if any, causes a recording defect.

In a case where, as shown in FIG. 12, recording is performed on a recording medium X by five head sections H1 to H5 disposed to alternate with one another, a misalignment of the head H2 toward the head H1, if any, causes a dark portion M, which is an overlap of dots of applied ink, and an unprinted white streak portion N to appear in the recording on the recording medium X.

To address this problem, mechanisms for finely adjusting the position of a head section have been developed.

For example, there has been known an inkjet head position adjustment mechanism that adjusts the position of an inkjet head that is fixed on a carriage (see, for example, PTL 1). The position adjustment mechanism is configured such that an inkjet head 10 can be moved in +X, −X, +Y, and −Y directions on a reference surface of a pedestal 18 of a carriage by loosening a fixing screw and the inkjet head 10 can be fixed under pressure by tightening the fixing screw.

Further, there has been known an ink head (head section) position adjustment mechanism including: a first guide section formed to extend on a first side of a nozzle formation surface of an ink head in a longitudinal direction; a second guide section formed to extend on a second side of the nozzle formation surface of the ink head in the longitudinal direction; a contact member disposed to make contact with the first guide section; a top that spins; a top moving section for moving the ink head with the contact member as a fulcrum by means of a slide of the top and the second guide section on each other; and a graduated section that rotates by means of the spinning of the top (see, for example, PTL 2).

Further, there has been known a head unit in which a plurality of heads each having an arrangement of nozzles from which droplets are ejected are arranged on an array base member (see, for example, PTL 3). Each of the heads is held by a first plate member. The first plate member is held by a second plate member. The first plate member is rotatable on a Z axis with respect to the second plate member. The Z axis is perpendicular to a nozzle surface of the head and passes through a center position of a particular nozzle of the head. By screwing a screw into a screw hole of the array base member via a long hole of the second plate member and loosening the screw, the second plate member is made movable in an X-axis direction with respect to the array base member.

CITATION LIST

Patent Literature

PTL 1: Japanese Patent Application Laid-Open No. 2001-113679

PTL 2: Japanese Patent Application Laid-Open No. 2005-305920

PTL 3: Japanese Patent Application Laid-Open No. 2014-14972

SUMMARY OF INVENTION

Technical Problem

However, although the position adjustment mechanism described in PTL 1 enables the ink head to move in a longitudinal direction and the head unit described in PTL 3 enables the second plate member to move in a longitudinal direction, the ink head and the second plate member are moved by loosening screws and therefore cannot be said to be moved with a high degree of accuracy. Further, even if the ink head and the second plate member are moved to appropriate positions, they are undesirably misaligned in tightening the screws.

Since the position adjustment mechanism described in PTL 2 adjusts the position of a head section by turning the head section, it cannot be said to adjust the position of the head section in a longitudinal direction with a high degree of accuracy. Further, turning some head section causes the head section to tilt, thus varying the distance between dots of ink to be applied. Then, an attempt to align the head section with another head section in the longitudinal direction ends up with a slight misalignment because of variations in the distance between dots of ink.

The present invention has been made in view of the foregoing circumstances and has as an object to provide a head position adjustment mechanism and a line head that make it possible to easily adjust the position of a head section in a longitudinal direction (X-axis direction) with a high degree of accuracy.

Solution to Problems

The present inventors diligently studied to solve the foregoing problems and found that the foregoing problems can be solved by fixing a head section with a head fixing section, providing a linear-motion mechanism for guiding the head fixing section, further bringing a tapered part of a tapered pin into contact with a first end of the head fixing section in an X-axis direction, and biasing a second end of the head fixing section in the X-axis direction toward the tapered pin with a plunger.

The present invention is directed to (1) a head position adjustment mechanism for adjusting a position of a head section of an inkjet recording apparatus having a plurality of head sections in an X-axis direction that is a longitudinal direction of the head section, including: a head fixing section for fixedly supporting the head section, the head fixing section having a rectangular shape in a top view; a linear-motion mechanism to which the head fixing section has been attached; and a bracket to which the linear-motion mechanism has been attached, wherein the linear-motion mechanism serves to guide the head fixing section in the X-axis direction with respect to the bracket, the bracket has a tapered pin attached to the bracket and a plunger attached to the bracket, the tapered pin having a tapered part, the plunger having a unidirectional biasing function, the tapered pin and the plunger facing each other, the tapered pin has its tapered part brought into contact with a first side end of the head fixing section in the X-axis direction, the plunger biases a second side end of the head fixing section in the X-axis direction toward the tapered pin, and moving the tapered pin up and down causes the head fixing section to linearly move in the X-axis direction so that a position of the head fixing section is adjusted.

The present invention is directed to (2) the head position adjustment mechanism according to (1), wherein the head fixing section has a connecting plate provided at the first side end of the head fixing section in the X-axis direction, and the tapered pin has its tapered part brought into contact with the connecting plate.

The present invention is directed to (3) the head position adjustment mechanism according to (1) or (2), wherein the tapered pin is screwed to the bracket.

The present invention is directed to (4) the head position adjustment mechanism according to (3), further including an electric actuator or an electric motor for turning the tapered pin.

The present invention is directed to (5) the head position adjustment mechanism according to any one of (1) to (4), wherein the linear-motion mechanism includes a slide unit section and a track rail section on which the slide unit section is slidable, the slide unit section is attached to the head fixing section, and the track rail section is attached to the bracket.

The present invention is directed to (6) the head position adjustment mechanism according to (1) to (5), wherein the head section has a first flange part provided at a first side end of the head section in the X-axis direction and a second flange part provided at a second side end of the head section in the X-axis direction, the first flange part being provided with a notch having a V shape in a top view, the second flange part having an L shape in a top view, the head fixing section has a pair of positioning pins provided on both sides, respectively, of the head fixing section, and the head section is fixedly supported by the head fixing section by fixing the first flange part and the second flange part using screws in a state where the first flange part and the second flange part are in contact with their corresponding ones of the positioning pins, respectively.

The present invention is directed to (7) the head position adjustment mechanism according to any one of (1) to (6), wherein the head section is a line recording head having a nozzle formed in a lower surface thereof.

The present invention is directed to (a) a line head including: a first head section obtained by attaching the head position adjustment mechanism according to any one of (1) to (7) to a head section; a second head section obtained by not attaching the head position adjustment mechanism to a head section; and a block frame to which the first head section and the second head section have been attached.

Advantageous Effects of Invention

The head position adjustment mechanism of the present invention is configured such that the head fixing section by which the head section is fixed supported is guided by the linear-motion mechanism in the X-axis direction with respect to the bracket.

This prevents the orientation of the head section from tilting with respect to the orientation of another head section, so that the distance between dots of ink to be applied is held constant across all head sections.

Since, in the head position adjustment mechanism of the present invention, the tapered pin has its tapered part brought into contact with the first side end of the head fixing section in the X-axis direction and the plunger biases the second side end of the head fixing section in the X-axis direction toward the tapered pin, the head fixing section is in a state of being held between the tapered pin and the plunger.

Moreover, moving the tapered pin up and down the from this state causes the position of contact between the head fixing section and the tapered part to shift in the X-axis direction on the basis of the inclination of the tapered part, and the biasing of the plunger causes the head fixing section to follow the shift. This causes the head fixing section to slightly move, thus making it possible to adjust the position of the head section in the X-axis direction with a high degree of accuracy.

Since, in the head position adjustment mechanism of the present invention, a movement of the tapered pin in a vertical direction is converted into a movement of the head fixing section in the X-axis direction, the position of the head section in the X-axis direction can be easily adjusted.

Further, in this case, the degree of movement of the head fixing section in the X-axis direction can be recognized from the degree of movement of the tapered pin in the vertical direction.

Since the head position adjustment mechanism of the present invention is configured such the connecting plate is attached to the first side end of the head fixing section in the X-axis direction and the tapered pin has its tapered part brought into contact with the connecting plate, moving the tapered pin up and down causes the position of contact between the connecting plate and the tapered part to shift in the X-axis direction on the basis of the inclination of the tapered part, and the biasing of the plunger causes the connecting plate and the head fixing section to follow the shift. This causes the head fixing section to slightly move, thus making it possible to adjust the position of the head section in the X-axis direction with a high degree of accuracy.

Further, while shifting the position of contact between the tapered part and the connecting plate by moving the tapered pin up and down may cause the connecting plate to wear, only the connecting plate can be detached and replaced, as the connecting plate is attached to the head fixing section.

By the way, in a case where the head fixing section is replaced, a complicated procedure is required, as the whole head position adjustment mechanism needs to be disassembled.

Since, in the head position adjustment mechanism of the present invention, a rotational movement of the tapered pin is converted into a movement of the tapered pin in the vertical direction and, furthermore, this is converted into a movement of the head fixing section in the X-axis direction in a case where the tapered pin is screwed to the bracket, the position of the head section in the X-axis direction can be more easily adjusted.

Further, in this case, the degree of movement of the tapered pin in the vertical direction and the degree of movement of the head fixing section in the X-axis direction can be easily recognized from the degree of rotation of the tapered pin.

At this point in time, in a case where the head position adjustment mechanism further includes an electric actuator or an electric motor for turning the tapered pin, the tapered pin can be rotated with a higher degree of accuracy and the degree of rotation of the tapered pin can be recognized with a higher degree of accuracy.

In a case where the head position adjustment mechanism of the present invention is configured such that the linear-motion mechanism includes a slide unit section and a track rail section on which the slide unit section is slidable, the frictional resistance with which the head fixing section moves can be minimized by attaching the slide head unit section to the head fixing section and attaching the track rail section to the bracket. This in turn makes it possible to smoothly move the head fixing section with respect to the bracket.

By configuring the head position adjustment mechanism of the present invention such that the head section is provided with a first flange part and a second flange part, that the head fixing section is provided with a pair of positioning pins, and that the first flange part and the second flange part are fixed using screws in a state where the first flange part and the second flange part are in contact with their corresponding ones of the positioning pins, respectively, the head section is fixed in position with respect to the head fixing section.

This makes it possible to easily position the head section with respect to the head fixing section and integrate the head section and the head fixing section with each other.

In a case where the head section is a line recording head, the head position is fixed for use and requires a more highly accurate position adjustment; therefore, the head position adjustment mechanism of the present invention can be more suitably used.

Since the first head section has a head position adjustment mechanism, the line head of the present invention makes it possible to easily adjust the position of the first head section in a longitudinal direction (X-axis direction) with respect to the second head section, which has no head position adjustment mechanism, with a high degree of accuracy.

BRIEF DESCRIPTION OF DRAWINGS

FIG. 10(*b*) is a top view showing a line head according to the present embodiment.

DESCRIPTION OF EMBODIMENTS

Figure 1A:
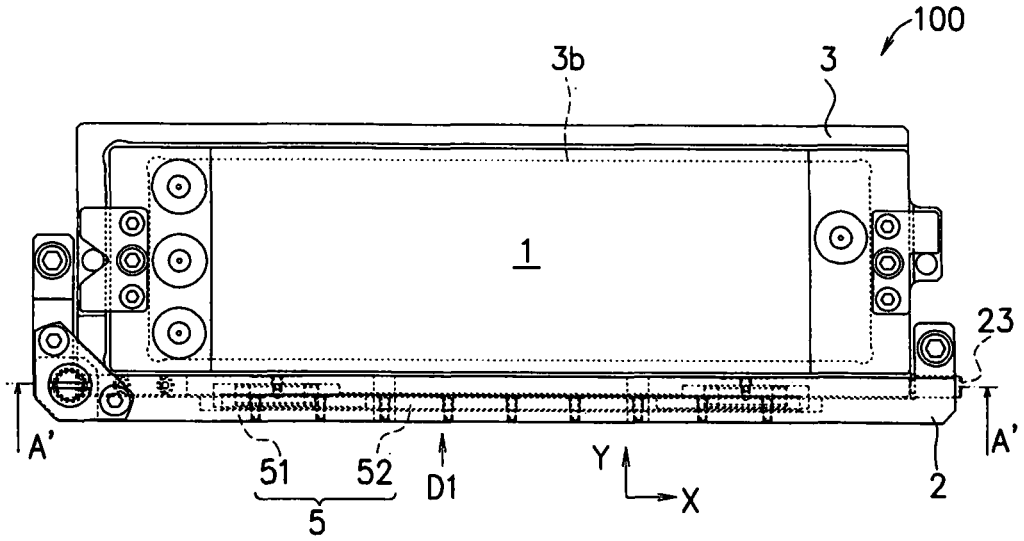
FIG. 1(*a*) illustrates a top view showing a head position adjustment mechanism according to the present embodiment and FIG. 1(*b*) a side view of the head position adjustment mechanism in the direction of an arrow D1 in FIG. 1(*a*).

The following describes a preferred embodiment of the present invention in detail with reference to the drawings on an as-needed basis. It should be noted that, in the drawings, identical elements are given identical reference signs, and a repeated description is omitted. Further, unless otherwise noted, positional relationships such as up, down, left, and right are based on the positional relationships shown in the drawings. Furthermore, the scale ratios of the drawings are not limited to the illustrated ratios.

A head position adjustment mechanism according to the present invention is used in a so-called inkjet recording apparatus that performs recording on a fed recording medium by ejecting ink from a head section.

Specifically, the head position adjustment mechanism is used for adjusting the position of the head section of the inkjet recording apparatus in a longitudinal direction.

It should be noted that it is assumed herein that the head section has a rectangular shape in a top view, that the longitudinal direction of the head section is an X-axis direction, that a direction perpendicular to the X-axis direction in a horizontal view is a Y-axis direction, and that a vertical direction orthogonal to these directions is a Z-axis direction.

Figure 1B:
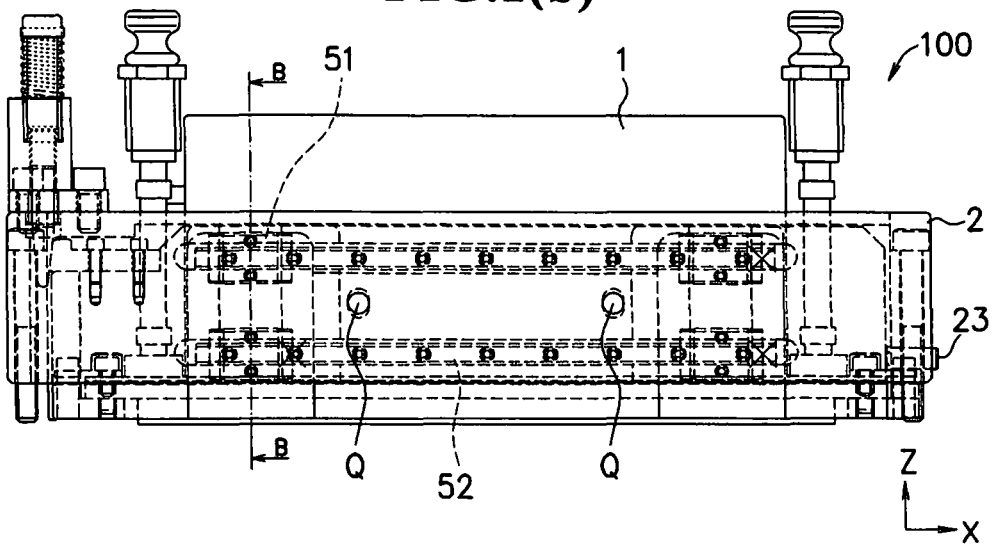

FIG. 1(*a*) illustrates a top view showing a head position adjustment mechanism according to the present embodiment and FIG. 1(*b*) a side view of the head position adjustment mechanism in the direction of an arrow D1 in FIG. 1(*a*).

As shown in FIGS. 1(*a*) and (*b*), a head position adjustment mechanism 100 according to the present embodiment includes a head fixing section 3 for fixedly supporting a head section 1, a linear-motion mechanism 5 to which the head fixing section 3 is attached, and a bracket 2 to which the linear-motion mechanism 5 is attached.

The head position adjustment mechanism 100 makes it possible to easily adjust the position of the head section 1 in the X-axis direction with a high degree of accuracy by linearly moving the head section 1 in the X-axis direction.

Figure 2A:
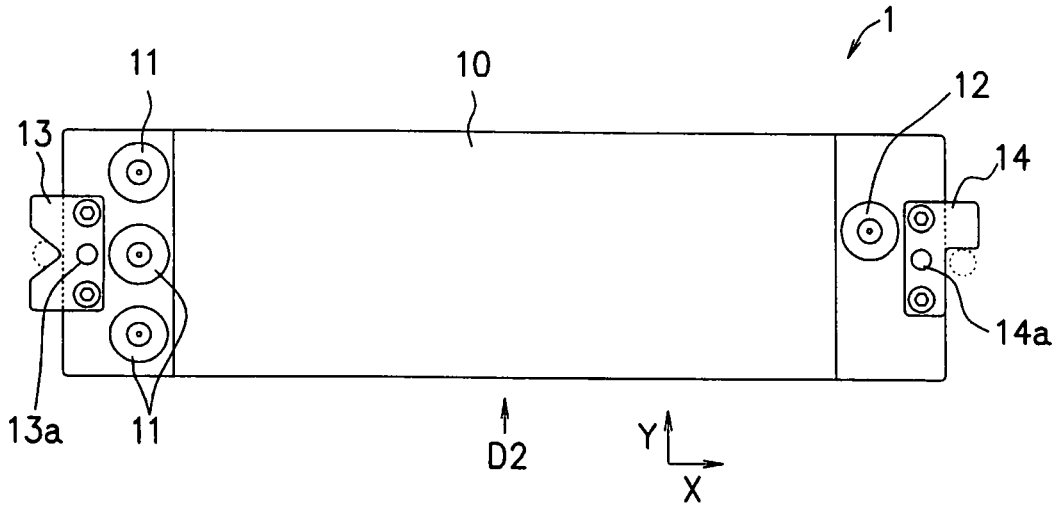
FIG. 2(*a*) illustrates a top view showing a head section that is attached to the head position adjustment mechanism according to the present embodiment and FIG. 2(*b*) a side view of the head section in the direction of an arrow D2 in FIG. 2(*a*).
Figure 2B:
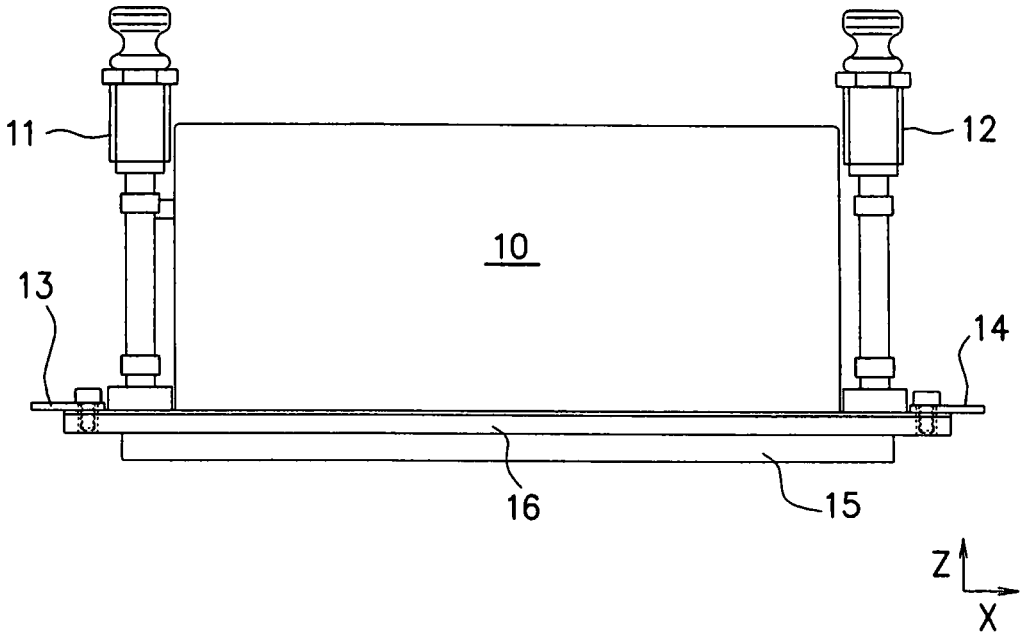

FIG. 2(*a*) illustrates a top view showing a head section that is attached to the head position adjustment mechanism according to the present embodiment and FIG. 2(*b*) a side view of the head section in the direction of an arrow D2 in FIG. 2(*a*).

As shown in FIGS. 2(*a*) and (*b*), the head section 1, which is attached to the head position adjustment mechanism 100, includes a body part 10, a nozzle plate 15 attached to a lower surface of the body part 10, an ink inlet 11 through which ink flows into the body part 10, and an ink outlet 12 through which ink flows out from the body part 10.

In the head section 1, the body part 10 is in the shape of a rectangular box in a top view and is capable of storing ink in an interior of the body part 10.

Moreover, the ink inlet 11 and the ink outlet 12 stands on both sides, respectively, of the body part 10 in the X-axis direction. That is, the ink inlet 11 is provided on a first side (left side in FIG. 2(*b*)) of the body part 10, and the ink outlet 12 is provided on a second side (right side in FIG. 2(*b*)) of the body part 10.

In the head section 1, the body part 10 has its interior communicating with the ink inlet 11 and the ink outlet 12 so that ink having flowed in through the ink inlet 11 is stored in the interior of the body part 10.

Further, during cleaning, a cleaning liquid having flowed in through the ink inlet 11 flows out through the ink outlet 12 via the interior of the body part 10.

The nozzle plate 15 has a plurality of nozzles (not illustrated) formed in a lower surface of the nozzle plate 15.

The head section 1 is configured such that ink stored in the body part 10 is ejected downward in the form of fine droplets by the nozzles. That is, the head section 1 serves as a so-called line recording head that, in a fixed state, applies ink to a recording medium passing below the head section 1.

It should be noted that the head section 1 has a supporting base 16 provided on a part of the lower surface of the body part 10 that surrounds the nozzle plate 15 and it is this supporting base 16 that is supported by the head fixing section 3.

Note here that the head section 1 has a first flange part 13 provided at a first side (left side in FIG. 2(*a*)) end of the head section 1 in the X-axis direction and a second flange part 14 provided at a second side (right side in FIG. 2(*a*)) end of the head section 1 in the X-axis direction. The first flange part 13 is provided with a notch having a V shape in a top view. The second flange part 14 has an L shape in a top view.

Moreover, the first flange part 13 is provided with a first head section hole 13*a*, and the second flange part 14 is provided with a second head section hole 14*a*.

Figure 3A:
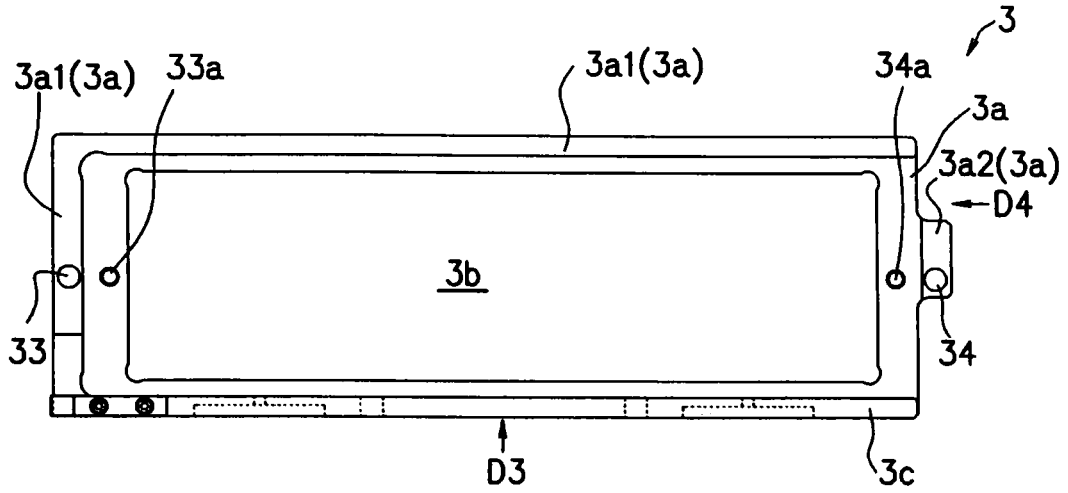
FIG. 3(*a*) illustrates a top view showing a head fixing section that is used in the head position adjustment mechanism according to the present embodiment, FIG. 3(*b*) a side view of the head fixing section in the direction of an arrow D3 in FIG. 3(*a*), and FIG. 3(*c*) a side view of the head fixing section in the direction of an arrow D4 in FIG. 3(*a*).
Figure 3B:
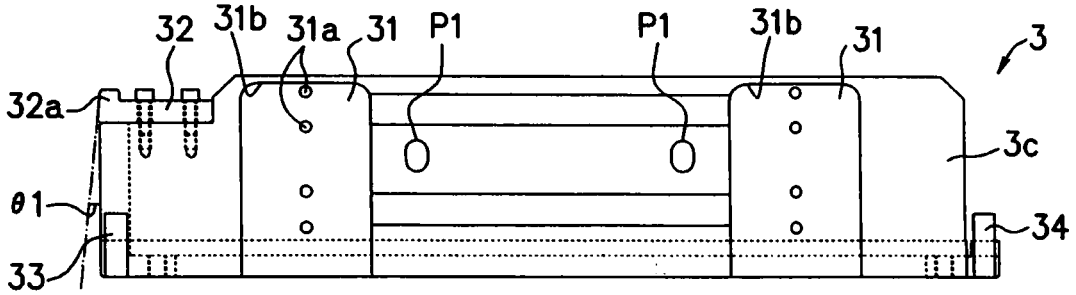
Figure 3C:
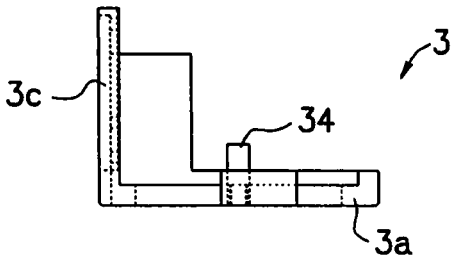

FIG. 3(*a*) illustrates a top view showing a head fixing section that is used in the head position adjustment mechanism according to the present embodiment, FIG. 3(*b*) a side view of the head fixing section in the direction of an arrow D3 in FIG. 3(*a*), and FIG. 3(*c*) a side view of the head fixing section in the direction of an arrow D4 in FIG. 3(*a*).

As shown in FIGS. 3(*a*), (*b*), and (*c*), the head fixing section 3, as a whole, has a rectangular shape in a top view and has an L shape in a side view.

The head fixing section 3 includes a flat supporting plate part 3*a*, a wall part (the wall part of the head fixing section 3 being hereinafter referred to as "first wall part") 3*c* standing at a first side edge along the long sides of the supporting plate part 3*a*, and a top-view rectangular void part 3*b* provided in the center of the supporting plate part 3*a*.

In the head fixing section 3, the supporting plate part 3*a* has a top-view L-shaped step 3*a*1 provided at an edge along the long sides of the supporting plate part 3*a* opposite to the first wall part 3*c* and at a first side edge along the short sides of the supporting plate part 3*a*. Further, the supporting plate part 3*a* has a step 3*a*2, provided at a second side edge along the short sides of the supporting plate part 3*a*, which protrudes toward the second side. That is, in the supporting plate part 3*a*, the step 3*a*1 and the step 3*a*2 are one step higher than the part they surround.

At the step 3*a*1 provided at a first side end of the supporting plate part 3*a* in the X-axis direction, a positioning pin 33 (hereinafter referred to as "first positioning pin") corresponding to the aforementioned first flange part 13 stands, and at the step 3*a*2 provided at a second side end of the supporting plate part 3*a* in the X-axis direction, a positioning pin 34 (hereinafter referred to as "second positioning pin") corresponding to the aforementioned second flange part 14 stands.

Further, the supporting plate part 3*a* has a first head fixing section screw hole 33*a* provided on a side of the first positioning pin 33 that is closer to the void part 3*b*, and the supporting plate part 3*a* has a second head fixing section screw hole 34*a* provided on a side of the second positioning pin 34 that is closer to the void part 3*b*.

The head position adjustment mechanism 100 is configured such that the position of the head section 1 with respect to the head fixing section 3 in the X-axis direction is determined by bringing the first flange part 13 of the head section 1 into contact with the first positioning pin 33 and the position of the head section 1 with respect to the head fixing section 3 in the Y-axis direction is determined by bringing the second flange part 14 of the head section 1 into contact with the second positioning pin 34 (see FIG. 1(*a*)).

Moreover, by fixing the first head section hole 13*a* and the first head section fixing section screw hole 33*a* to each other using a screw and fixing the second head section hole 14*a* and the second head fixing section screw hole 34*a* to each other using a screw in this state, the head section 1 is fixed in position with respect to the head fixing section 3, so that the head section 1 and the head fixing section 3 become integrated with each other.

At this point in time, the head section 1 is supported in position by the head fixing section 3 by bringing a lower surface of the supporting base 16 of the head section 1 into contact with an upper surface of the supporting plate part 3*a* of the head fixing section 3.

Further, the nozzle plate 15 of the head section 1 is inserted into the void part 3*b* of the head fixing section 3 so as to be exposed downward.

Therefore, in the head position adjustment mechanism 100, the head fixing section 3 fixedly supports the head section 1 so as not to prevent ink from being ejected downward from the nozzles of the head section 1.

In the head fixing section 3, an outer side of the first wall part 3*c* is attached to the linear-motion mechanism 5. It should be noted that the linear-motion mechanism 5 serves to guide the head fixing section 3 in the X-axis direction with respect to the bracket 2. It should be noted that the linear-motion mechanism 5 will be described later.

The outer side of the first wall part 3*c* is provided with two, namely, right and left, groove portions 31 (the groove portions 31 of the head fixing section 3 being hereinafter referred to as "first groove portions") for attachment to slide unit sections 51 of the linear-motion mechanism 5, and the first groove portions 31 are provided with holes 31*a* for attachment to the slide unit sections 51.

Note here that the first groove portions 31 have upper side surfaces (hereinafter referred to as "upper supporting surfaces 31*b*") that serve as reference surfaces for attachment of the slide unit sections 51 so as to be parallel to the upper surface of the supporting plate part 3*a*.

The head fixing section 3 has a connecting plate 32 provided on an upper side of a first side (left side in FIG. 3(*b*)) of the first wall part 3*c* in the X-axis direction.

Specifically, to the upper side of the first side (left side in FIG. 3(*b*)) of the first wall part 3*c* in the X-axis direction, the connecting plate 32, which has an inclined contact surface 32*a*, is fixedly attached using screws in a state where a surface of the connecting plate 32 opposite to the contact surface 32*a* is in contact with the head fixing section 3.

The connecting plate 32 has its contact surface 32*a* to be brought into contact with a tapered part 22*d* of the after-mentioned tapered pin 22. It should be noted that although, in the head position adjustment mechanism 100, the connecting plate 32 is pressed in the X-axis direction according to the movement of the tapered pin 22 in the Z-axis direction as will be mentioned later, the movement of only the connecting plate 32 in the X-axis direction with respect to the head fixing section 3 can be surely prevented, as the connecting plate 32 is fixed using the screws in a state where the surface of the connecting plate 32 opposite to the contact surface 32*a* is in contact with the head fixing section 3.

Note here that the contact surface 32*a* of the connecting plate 32 is inclined toward the head section 1 upward so as to correspond to the tapered part 22*d* of the tapered pin 22.

At this point in time, it is preferable that an angle of inclination θ1 of the contact surface 32*a* with respect to the Z-axis direction be an angle that is substantially identical to an angle of inclination θ2 of the tapered part 22*d*. That is, it is preferable that the contact surface 32*a* and the tapered part 22*d* be in line contact with each other.

In the head position adjustment mechanism 100, the head fixing section 3 is brought into contact with the tapered pin 22 via the connecting plate 32. This makes it possible to prevent the head fixing section 3 per se from wearing.

Further, the connecting plate 32 can be easily detached from the head fixing section 3 by removing the screws. Further, when the connecting plate 32 is attached, the connecting plate 32 can be easily attached to a reference position in the X-axis direction simply by being fixed using the screws in a state where the surface of the connection plate 32 opposite to the contact surface 32*a* is in contact with the head fixing section 3. This makes it possible to easily replace the connecting plate 32 in a case where the connecting plate 32 wears. It should be noted that since the angle of inclination θ1 of the contact surface 32*a* with respect to the Z-axis direction is matched to the angle of inclination θ2 of the tapered part 22*d*, the connecting plate 32 can be replaced as the tapered pin 22 is replaced.

Figure 4A:
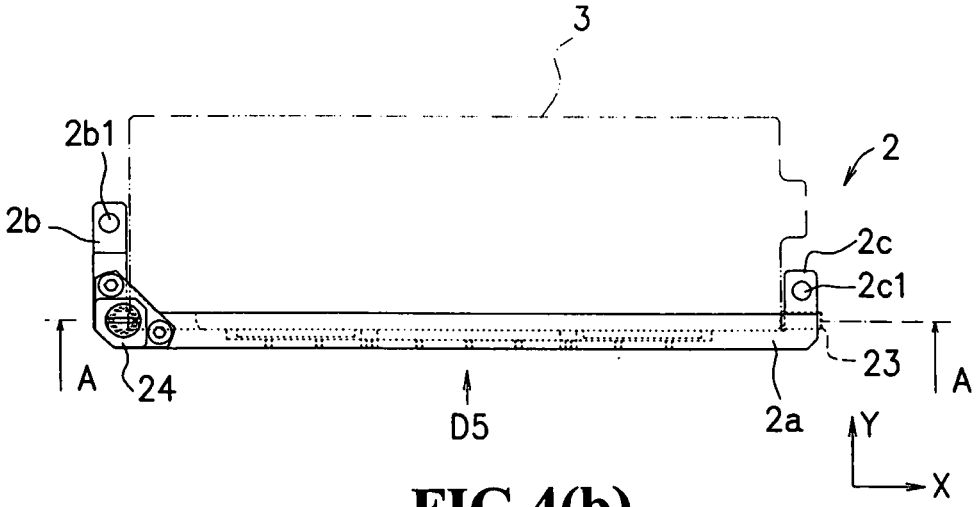
FIG. 4(*a*) illustrates a top view showing a bracket that is used in the head position adjustment mechanism according to the present embodiment, FIG. 4(*b*) a side view of the bracket in the direction of an arrow D5 in FIG. 4(*a*), and FIG. 4(*c*) a partial cross-sectional view of the bracket as taken along line A-A in FIG. 4(*a*).
Figure 4B:
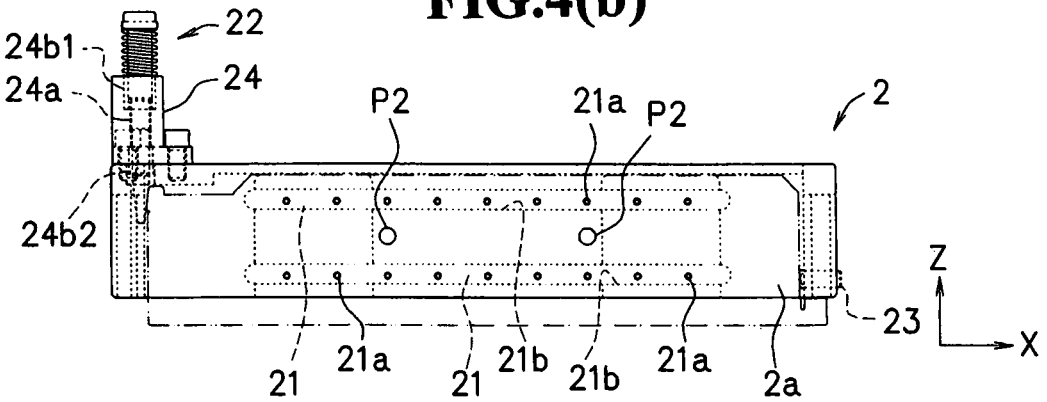
Figure 4C:
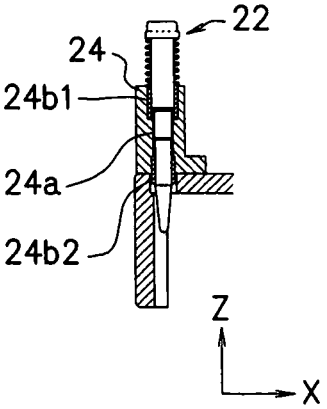

FIG. 4(*a*) illustrates a top view showing a bracket that is used in the head position adjustment mechanism according to the present embodiment, FIG. 4(*b*) a side view of the bracket in the direction of an arrow D5 in FIG. 4(*a*), and FIG. 4(*c*) a partial cross-sectional view of the bracket as taken along line A-A in FIG. 4(*a*).

As shown in FIGS. 4(*a*) and (*b*), the bracket 2 includes a wall part 2*a* (the wall part of the bracket 2 being hereinafter referred to as "second wall part") extending in the X-axis direction, a first lateral wall part 2*b* extending in the Y-axis direction from a first side (left side in FIG. 4(*a*)) end of the second wall part 2*a*, and a second lateral wall part 2*c* extending in the Y-axis direction from a second side (right side in FIG. 4(*a*)) end of the second wall part 2*a*, and the first lateral wall part 2*b* and the second lateral wall part 2*c* face each other. That is, the bracket 2 has a U shape in a top view.

The bracket 2 is disposed to extend along the perimeter of the head fixing section 3 (see FIG. 1(*a*)).

At this point in time, as will be mentioned later, the first wall part 3*c* of the head fixing section 3 is coupled to the second wall part 2*a* via the linear-motion mechanism 5.

Further, the first lateral wall part 2*b* and the second lateral wall part 2*c* are both provided at a certain distance from the supporting plate part 3*a* of the head fixing section 3. For this reason, the movement of the head fixing section 3 in the X-axis direction is not inhibited.

In the bracket 2, the second wall part 2*a* has two, namely upper and lower, groove portions 21 (the groove portions 21 of the bracket 2 being hereinafter referred to as "second groove portions") provided in an inner side of the second wall part 2*a* for attachment of track rail sections 52 of the linear-motion mechanism 5, and the second groove portions 21 are provided with screw holes 21*a* for attachment of the track rail sections 52. It should be noted that the two second groove portions 21 both extend in the X-axis direction and are parallel to each other.

Note here that the second groove portions 21 have lower side surfaces (hereinafter referred to as "lower supporting surfaces 21*b*") that serve as reference surfaces for attachment of the track rail sections 52 so as to be parallel to the upper surface of the supporting plate part 3*a*.

The bracket 2 has a first bracket hole 2*b*1 provided at an end of the first lateral wall part 2*b* opposite to the second wall part 2*a* and has a second bracket hole 2*c*1 provided at an end of the second lateral wall part 2*c* opposite to the second wall part 2*a*.

Moreover, by fixing the first and second bracket holes 2*b*1 and 2*c*1 and block frame screw holes 4*b*, which are provided in the after-mentioned block frame 4, to each other using screws, the bracket 2 is fixed in position with respect to the block frame 4, so that the bracket 2 and the block frame 4 become integrated with each other.

The bracket 2 has a plunger 23 attached to a corner formed by the second wall part 2*a* and the second lateral wall part 2*c*.

Figure 5:
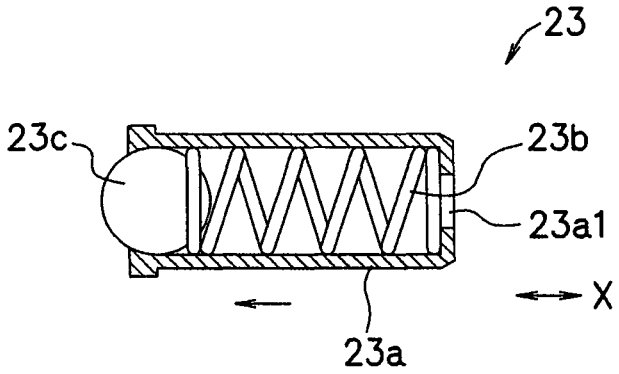
FIG. 5 is a cross-sectional view showing a plunger that is used in the head position adjustment mechanism according to the present embodiment.

FIG. 5 is a cross-sectional view showing a plunger that is used in the head position adjustment mechanism according to the present embodiment.

As shown in FIG. 5, the plunger 23 includes a bottomed circular cylindrical box part 23*a*, a biasing spring part 23*b* accommodated in the box part 23*a*, and a ball part 23*c* provided at one end of the biasing spring part 23*b* by being held so that at least a part of the ball part 23*c* is exposed from an opening of the box part 23*a*. It should be noted that the box part 23*a* has a vent hole 23*a*1 provided in the bottom.

The plunger 23 has a unidirectional biasing capability.

With continued reference to FIG. 4(*b*), the plunger 23 has its box part 23*a* fixed to the bracket 2 and has its ball part 23*c* brought into contact with the head fixing section 3.

Moreover, the biasing spring part 23*b* has a spring force that causes the ball part 23*a* to bias the head fixing section 3.

That is, in the head position adjustment mechanism 100, the plunger 23 attached to the bracket 2 is always in a state of biasing the head fixing section 3 toward the first lateral wall part 2*b* along the X axis (see FIG. 1(*b*)).

The bracket 2 has a coupling part 24 attached to an upper side of the corner formed by the second wall part 2*a* and the first lateral wall part 2*b*.

Further, as shown in FIG. 4(*c*), the coupling part 24 is provided with a through-hole through which the tapered pin 22 is inserted.

Note here that the coupling part 24 includes a thread part 24*a* having a thread groove formed in an inner wall surface of the through-hole and upper and lower guides 24*b*1 and 24*b*2 for guiding the tapered pin 22. The upper guide 24*b*1, the thread part 24*a*, and the lower guide 24*b*2 are provided in this order from the top.

Figure 6:
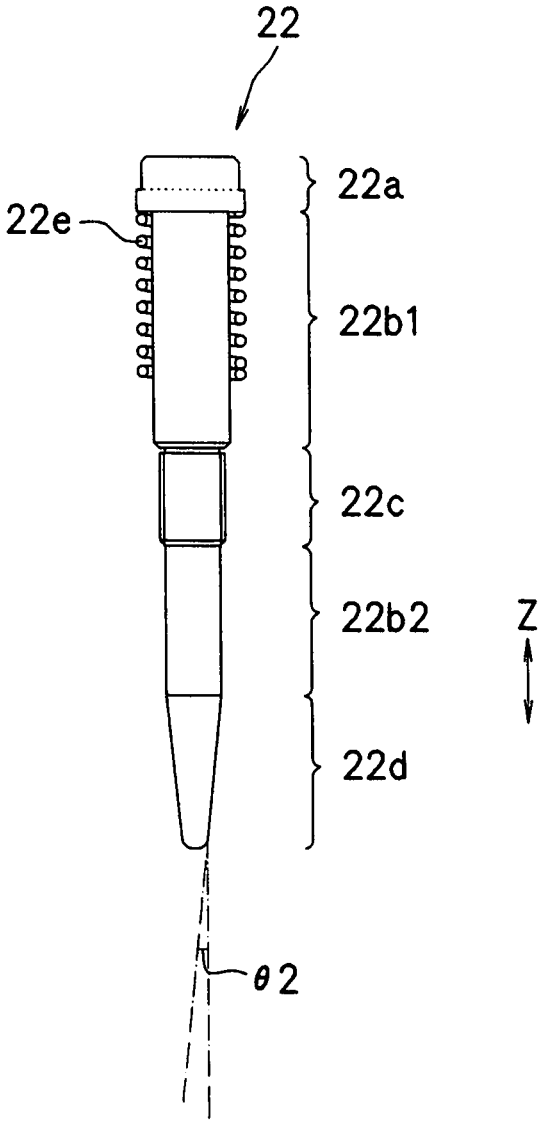
FIG. 6 is a front view showing a tapered pin that is used in the head position adjustment mechanism according to the present embodiment.

FIG. 6 is a front view showing a tapered pin that is used in the head position adjustment mechanism according to the present embodiment.

As shown in FIG. 6, the tapered pin 22 includes a head part 22*a*, an upper support 22*b*1 extending downward from the head part 22*a*, a screw part 22*c* that continues into the upper support 22*b*1, a lower support 22*b*2 that continues into the screw part 22*c*, and the tapered part 22*d*, provided at a lower end of the tapered pin 22, which continues into the lower support 22*b*2.

Further, the upper support 22*b*1 of the tapered pin 22 is surrounded by a pressure spring part 22*e* held between the head part 22*a* and the coupling part 24 (see FIG. 4(*c*)).

In the tapered pin 22, the screw part 22*c* is turnably screwed to the thread part 24*a* of the coupling part 24, and the upper support 22*b*1 and the lower support 22*b*2 are supported and guided by the corresponding upper and lower guides 24*b*1 and 24*b*2, respectively, of the coupling part 24.

Moreover, the tapered pin 22 is moved in the Z-axis direction by turning the head part 22*a* of the tapered pin 22. The head part 22*a* of the tapered pin 22 is provided with a slit and a chamfer for turning the tapered pin 22.

At this point in time, the tapered pin 22 is in a state of being pressed upward with a constant force by the pressure spring part 22*e*. This makes it possible to prevent a backlash of the screw part 22*c*, thus making it possible to move the tapered pin 22 in the Z-axis direction with a higher degree of accuracy.

Further, a pressing force applied by the pressure spring part 22*e* to a lower surface of the head part 22*a* of the tapered pin 22 and an upper surface of the coupling part 24 acts as a force that prevents the tapered pin 22 from rotating with respect to the coupling part 24.

Therefore, the head position adjustment mechanism 100 also includes a function of fixing the head section 1 in position.

It should be noted that, in the head position adjustment mechanism 100, the pressure spring part 22*e* may be replaced, for example, by a pressure member such as a press screw or a plunger.

In the head position adjustment mechanism 100, since the tapered pin 22 is screwed to the thread part 24*a* of the coupling part 24 of the bracket 2, a rotational movement of the tapered pin 22 is converted into a movement of the tapered pin 22 in the Z-axis direction.

Further, since, as will be mentioned later, an amount of movement of the tapered pin 22 in the Z-axis direction is converted into an amount of movement of the head fixing section 3 in the X-axis direction, the position of the head section 1 in the X-axis direction can be easily adjusted.

At this point in time, by making the amount of movement of the head fixing section 3 in the X-axis direction smaller than the amount of movement of the tapered pin 22 in the Z-axis direction, the position of the head section 1 in the X-axis direction can be adjusted with a higher degree of accuracy.

Further, in this case, the degree of movement of the tapered pin 22 in the Z-axis direction and the degree of movement of the head fixing section 3 in the X-axis direction can be easily recognized from the degree of rotation of the head part 22*a* of the tapered pin 22.

That is, since the degree of rotation of the head part 22*a*, the degree of movement of the tapered pin 22 in the Z-axis direction, and the degree of movement of the head fixing section 3 in the X-axis direction are in proportion to one another, the degree of movement of the tapered pin 22 in the Z-axis direction and the degree of movement of the head fixing section 3 in the X-axis direction can be calculated, for example, by calculating the degree of movement of the tapered pin 22 in the Z-axis direction or the degree of movement of the head fixing section 3 in the X-axis direction per rotation of the head part 22*a*, even with a change in the degree of rotation of the head part 22*a*.

As mentioned above, the tapered part 22*d* of the tapered pin 22 is brought into contact with the contact surface 32*a* of the connecting plate 32 attached to the head fixing section 3.

Note here that it is preferable that the angle of inclination θ2 of the tapered part 22*d* with respect to a length direction of the tapered pin 22 be in a range of 5 degrees to 25 degrees. If the angle of inclination θ2 is smaller than 5 degrees, the distance that the head section 1 can move may be shorter than in a case where the angle of inclination θ2 falls within the range, and if the angle of inclination θ2 exceeds 25 degrees, it is more difficult to make a fine adjustment with a slight movement than in a case where the angle of inclination θ2 falls within the range.

Figure 7A:
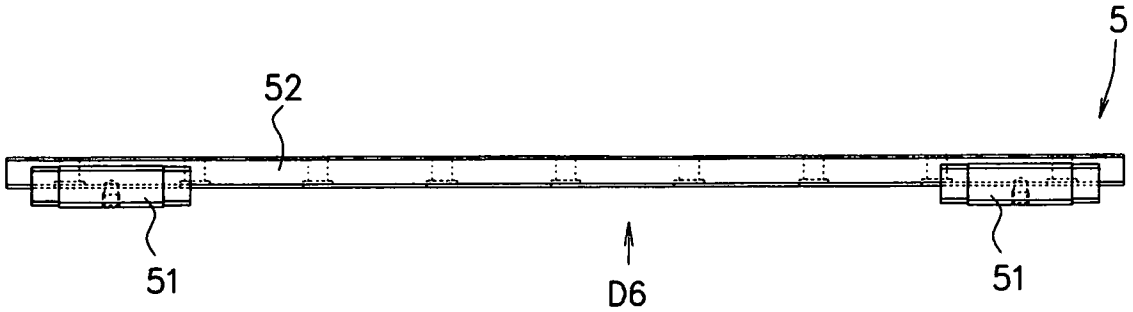
FIG. 7(*a*) illustrates a top view showing a linear-motion mechanism that is used in the head position adjustment mechanism according to the present embodiment and FIG. 7(*b*) a side view of the linear-motion mechanism in the direction of an arrow D6 in FIG. 7(*a*).
Figure 7B:
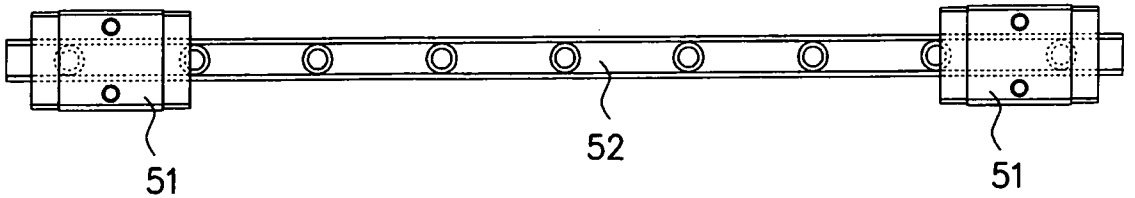

FIG. 7(*a*) illustrates a top view showing the linear-motion mechanism 5, which is used in the head position adjustment mechanism according to the present embodiment, and FIG. 7(*b*) illustrates a side view of the linear-motion mechanism 5 in the direction of an arrow D6 in FIG. 7(*a*).

As shown in FIGS. 7(*a*) and (*b*), the linear-motion mechanism 5 (linear guide) includes the slide unit sections 51 and the track rail sections 52, on which the slide unit sections 51 are slidable. It should be noted that, in the head position adjustment mechanism 100, two of these slide unit sections 51 are used for one of these track rail sections 52.

The linear-motion mechanism 5 is configured such that the slide unit sections 51 contain members such as balls and the members circulate by rolling between the slide unit sections 51 and the track rail sections 52. This allows the linear-motion mechanism 5 to smoothly move in a pre-compressed state even when used in a gapless state.

A state of connection between the head fixing section 3, the linear-motion mechanism 5, and the bracket 2 is described here.

Figure 8:
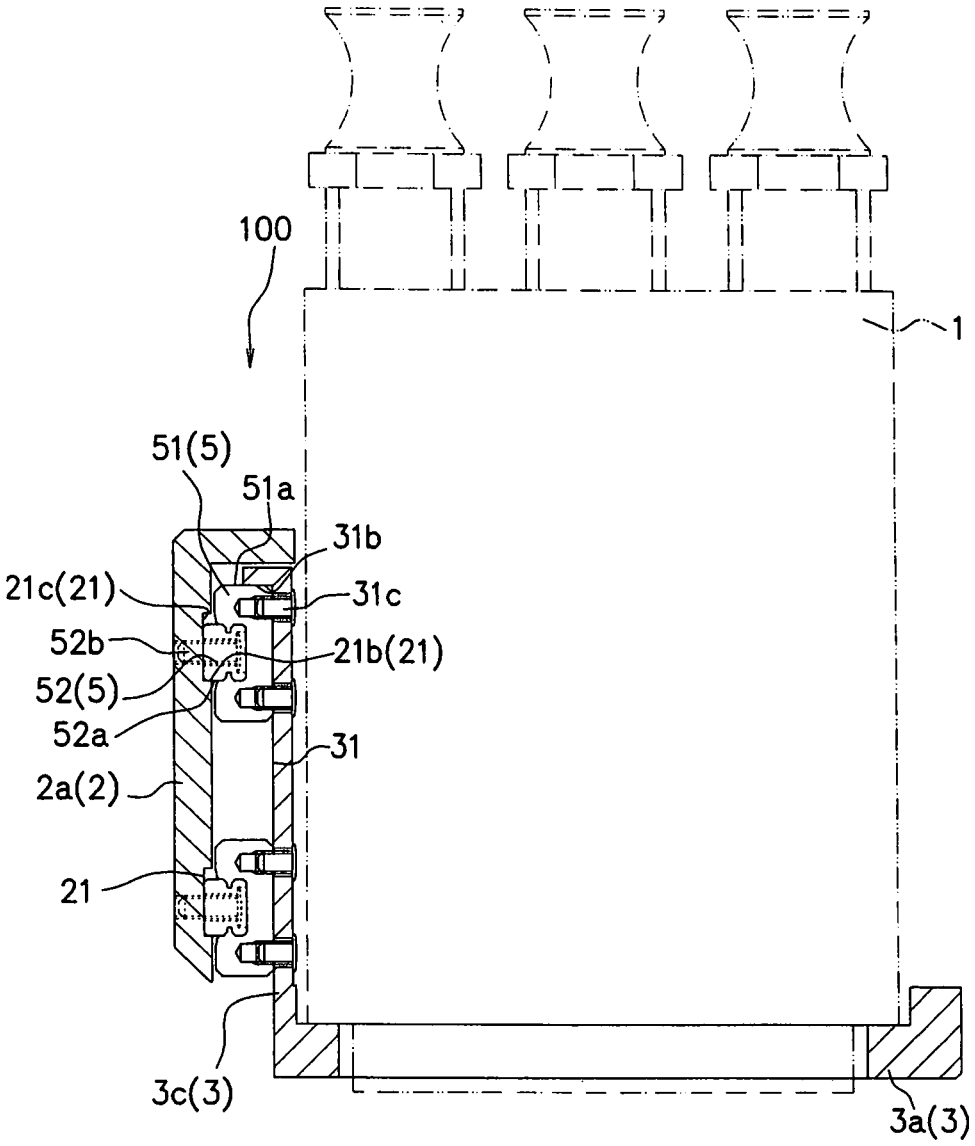
FIG. 8 is a partial cross-sectional view of the head position adjustment mechanism as taken along line B-B in FIG. 1(*b*).

FIG. 8 is a partial cross-sectional view of the head position adjustment mechanism as taken along line B-B in FIG. 1(*b*).

As shown in FIG. 8, two, namely upper and lower, slide unit sections 51 are fixedly attached to each of the first groove portions 31 outside the first wall part 3*c* of the head fixing section 3 using screws 31*c*. It should be noted that since the head fixing section 3 is provided with two first groove portions 31, the head fixing section 3 is provided with four slide unit sections 51.

More specifically, each of the slide unit sections 51 has an upper surface 51*a* that is parallel to the upper surface of the supporting plate part 3*a*. Moreover, at least the two upper slide unit sections 51 are fixed to the head fixing section 3 using the screws 31*c* in a state where their upper surfaces 51*a* are in contact with the upper supporting surfaces 31*b* of the first groove portions 31. This causes the head fixing section 3 to be attached to the slide unit sections 51 (linear-motion mechanism 5) so as to be supported from below.

It should be noted that the two upper slide unit sections 51 have their upper surfaces 51*a* flush with each other, and the two lower slide unit sections 51 have their upper surfaces 51*a* flush with each other.

In this way, the head fixing section 3 is in a state of being supported on the upper side of the upper surfaces 51*a* of the slide unit sections 51 of the linear-motion mechanism 5. This prevents the head section 1 and the head fixing section 3 from being displaced upward or downward due, for example, to their weights and vibrations and keeps them always parallel to each other. This keeps the head section 1 always parallel.

Meanwhile, the track rail sections 52 are fixedly attached to the second groove portions 21 inside the second wall part 2*a* of the bracket 2 using screws 52*b*, respectively.

At this point in time, each of the two second groove portions 21 has a structure notched into a U shape in a side view, and the width of each of the two second groove portions 21 in the Z-axis direction is wider than the width of each of the track rail sections 52 in the Z-axis direction.

More specifically, each of the track rail sections 52 has a lower surface 52*a* that is parallel to the upper surface of the supporting plate part 3*a*. Moreover, the track rail sections 52 are fixed to the bracket 2 using the screws 52*b* in a state where their lower surfaces 52*a* are in contact with the lower supporting surfaces 21*b* of the second groove portions 21 and are in contact with attaching and fixing surfaces 21*c*, which are back side surfaces of the second groove portions 21. This causes the track rail sections 52 (linear-motion mechanism 5) to be attached to the bracket 2 so as to be supported from below.

It should be noted that the two, namely upper and lower, track trail sections 52 are parallel to each other and have their longer sides extending in the X-axis direction.

In this way, the track rail sections 52 of the linear-motion mechanism 5 are in a state of being supported on the upper side of the lower supporting surface 21*b* of the bracket 2. This prevents the head section 1, the head fixing section 3, and the linear-motion mechanism 5 from being displaced upward or downward due, for example, to their weights and vibrations and keeps them always parallel to one another. This keeps the head section 1 always parallel.

Further, in the head position adjustment mechanism 100, the parallel arrangement of the two, namely, upper and lower, track rail sections 52 to each other provides the linear-motion mechanism 5 with the rigidity to be able to withstand a bending moment produced in the linear-motion mechanism 5 due to the weights of the head fixing section 3 connected to the linear-motion mechanism 5 and the head section 1 connected to the head fixing section 3.

This makes it possible to prevent the track rail sections 52 and the slide unit sections 51 from deforming due to the weights of the head fixing section 3 and the head section 1.

Thus, in the head position adjustment mechanism 100, the first wall part 3*c* of the head fixing section 3, the linear-motion mechanism 5, and the second wall part 2*a* of the bracket 2 are connected to one another.

Moreover, since the slide unit sections 51 provided to the head fixing section 3 are guided in the X-axis direction by the track rail sections 52, the head fixing section 3 becomes able to linearly move in the X-axis direction by being guided by the track rail sections 52 of the bracket 2.

Figure 9:
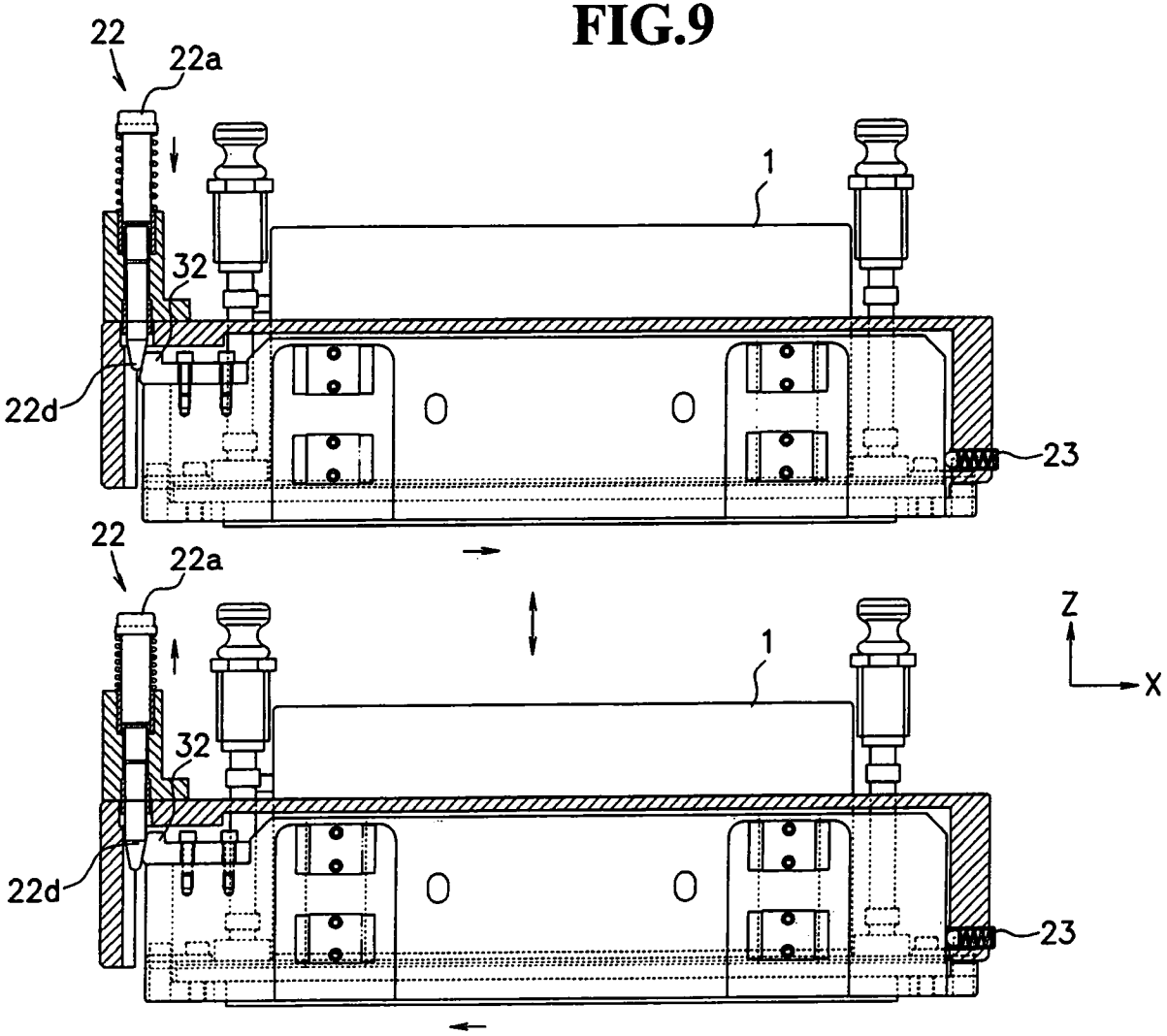
FIG. 9 is a cross-sectional view of the bracket as taken along line A'-A' in FIG. 1(*a*).

FIG. 9 is a cross-sectional view of the bracket as taken along line A'-A' in FIG. 1(*a*).

As shown in FIG. 9, in the head position adjustment mechanism 100, the tapered part 22*d* of the tapered pin 22 attached to the bracket 2 is in contact with a first side (left side in FIG. 9) end of the head fixing section 3 in the X-axis direction via the connecting plate 32, and a second side (right side in FIG. 9) end of the head fixing section 3 in the X-axis direction is biased toward the tapered pin 22 by the plunger 23 attached to the bracket 2. That is, the tapered pin 22 and the plunger 23 are attached to the bracket 2 so as to face each other with the head fixing section 3 interposed between the tapered pin 22 and the plunger 23.

Turning the head part 22*a* of the tapered pin 22 from this state causes the tapered pin 22 to move down in the Z-axis direction so that the tapered part 22*d* pushes out the head fixing section 3 toward the plunger 23 in the X-axis direction via the connecting plate 32 and the position of contact between the connecting plate 32 and the tapered part 22*d* shifts toward the plunger 23.

This causes the head fixing section 3 to linearly move toward the plunger 23 along the X-axis direction.

Since, at this point in time, the head fixing section 3 is in a state of being biased toward the tapered pin 22 by the plunger 23, the head fixing section 3 can be prevented from being moved too much by being pushed out by the tapered part 22*d*.

Meanwhile, turning the head part 22*a* of the tapered pin 22 in an opposite direction causes the tapered pin 22 to move up in the Z-axis direction so that the tapered part 22*d* stops pushing out the connecting plate 32 and, since the head fixing section 3 is biased toward the tapered pin 22 by the plunger 23 and therefore follows in the X-axis direction, the position of contact between the connecting plate 32 and the tapered part 22*d* shifts toward the tapered pin 22.

This causes the head fixing section 3 to linearly move toward the tapered pin 22 along the X-axis direction.

Since, at this point in time, the head fixing section 3 and the bracket 2 are connected to each other via the track rail sections 52 and the slide unit sections 51, the friction between the head fixing section 3 and the bracket 2 can be minimized so that a smooth movement can be achieved. That is, since, as mentioned above, the members, such as balls, circulate by rolling between the slide unit sections 51 and the track rail sections 52, a smooth motion can be achieved in a pre-compressed state even while using in a gapless state.

Figure 10A:
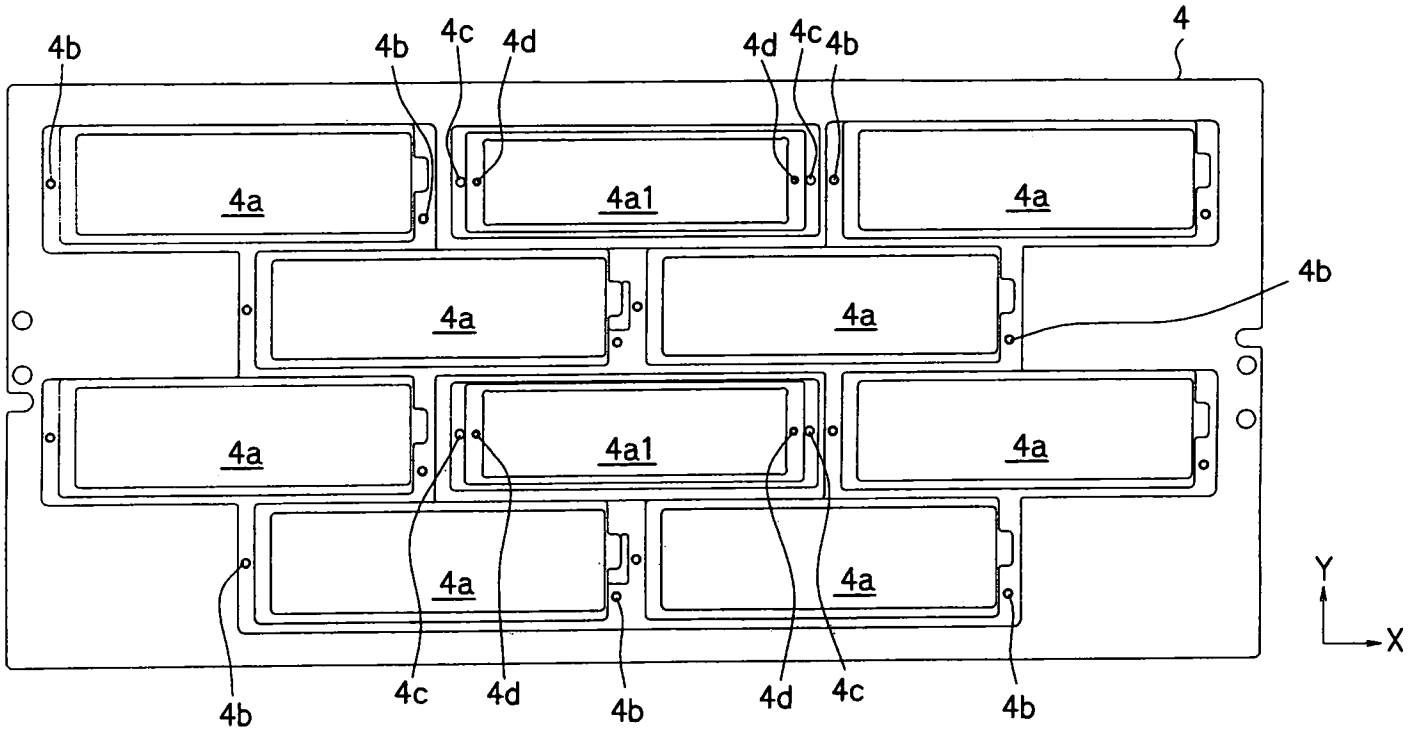
FIG. 10(*a*) is a top view showing a block frame to which head position adjustment mechanisms according to the present embodiment are to be attached.
Figure 10B:
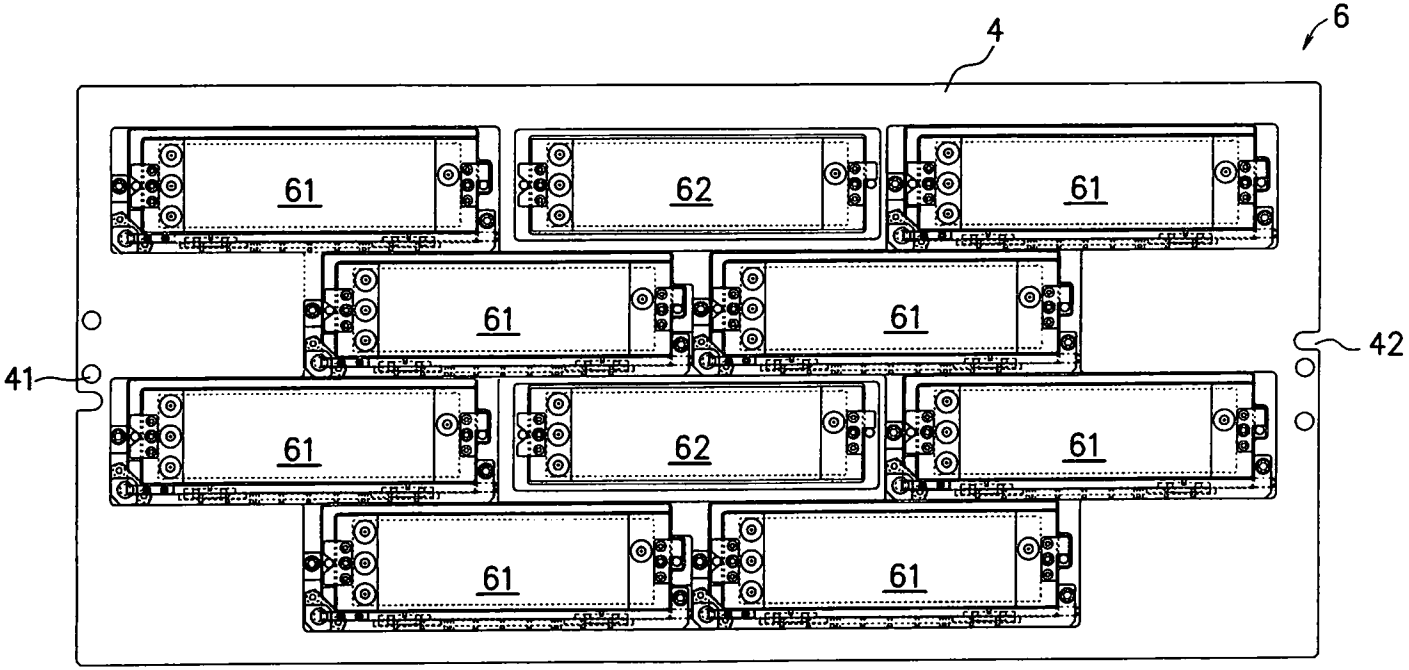
Figure 11A:
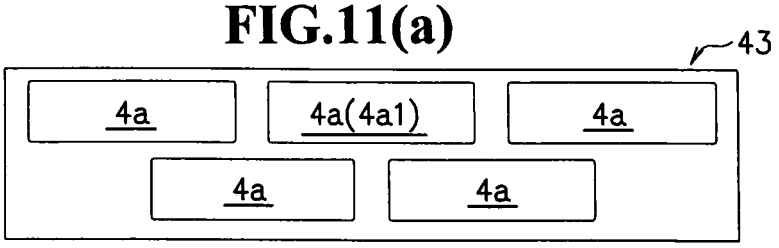
FIG. 11(*a*) illustrates a schematic top view showing another example of a block frame to which head position adjustment mechanisms according to the present embodiment are to be attached, FIG. 11(*b*) a schematic top view showing another example of a block frame to which head position adjustment mechanisms according to the present embodiment are to be attached, FIG. 11(*c*) a schematic top view showing another example of a block frame to which head position adjustment mechanisms according to the present embodiment are to be attached, and FIG. 11(*d*) a schematic top view showing another example of a block frame to which head position adjustment mechanisms according to the present embodiment are to be attached.
Figure 11B:
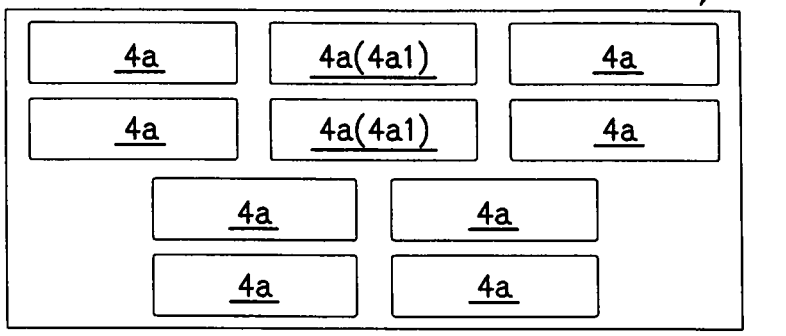
Figure 11C:
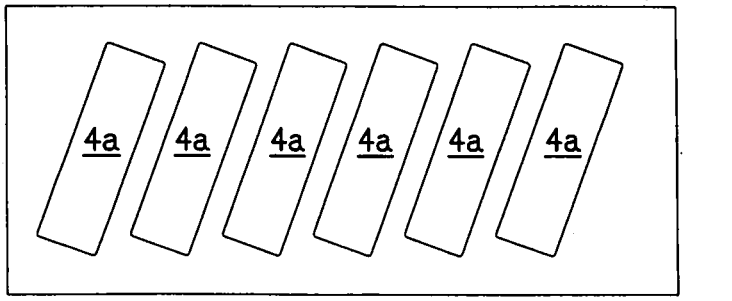
Figure 11D:
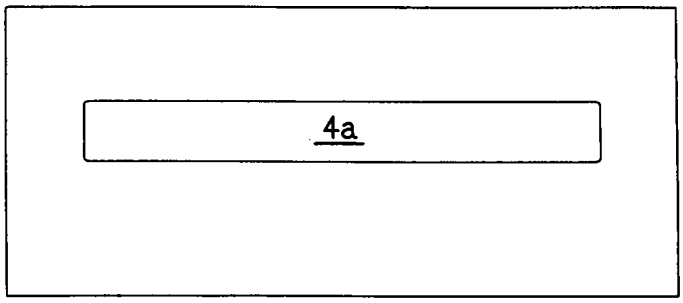
Figure 12:
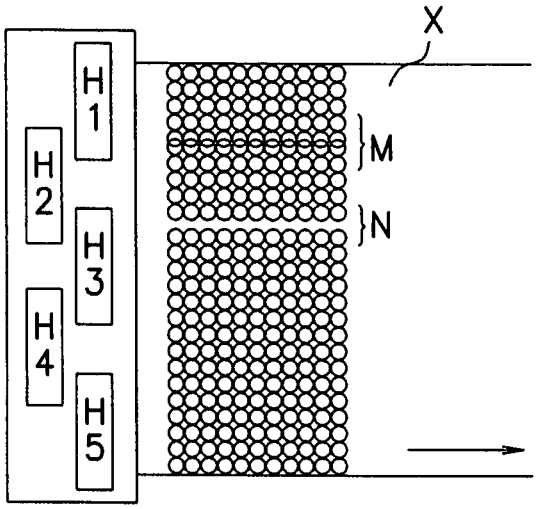
FIG. 12 is a schematic top view for explaining a conventional recording defect.

FIG. 10(*a*) is a top view showing a block frame to which the head position adjustment mechanisms according to the present embodiment are to be attached, and FIG. 10(*b*) is a top view showing a line head according to the present embodiment.

As shown in FIG. 10(*a*), a block frame 4 includes a plurality of head holes 4*a* each having a rectangle shape in a top view. Specifically, a row of two head holes 4*a* next to each other and a row of three head holes 4*a* next to one another are alternately arranged, and each of the head holes 4*a* is disposed to alternate with the other.

Further, of the plurality of head holes 4*a*, the head hole in the middle of each row of three head holes 4*a* next to one another serves as a reference head hole 4*a*1.

As shown in FIG. 10(*b*), a line head 6 according to the present embodiment includes first head sections 61 obtained by attaching head position adjustment mechanisms 100 to head sections 1, second head sections 62 obtained by not attaching head position adjustment mechanisms 100 to head sections 1, and a block frame 4 to which the first head sections and the second head sections have been attached. It should be noted that the second head sections 62 are substantially identical to the head sections 1, as no head position adjustment mechanisms 100 have been attached to the second head sections 62.

In the line head 6, the second head sections 62 are attached to the reference head holes 4*a*1 of the block frame 4. It should be noted that since the second head sections 62 serve as references for the positions of the first head sections 61, the second head sections 62 are not subjected to fine head position adjustment.

Further, a pair of positioning pins 4*c* stand on both sides, respectively, of each of the reference head holes 4*a*1 in the X-axis direction, and block frame screw holes 4*d* are provided closer to the center of the reference head hole 4*a*1 than the pair of positioning pins 4*c*, respectively. Therefore, the second head sections 62 are attached to the reference head holes 4*a*1 in a way similar to the aforementioned attachment of the head section 1 to the head fixing section 3.

Further, the head sections 61 are attached to the other head holes 4*a*. For this reason, block frame screw holes 4*b* corresponding to the first and second bracket holes 2*b*1 and 2*c*1 of the aforementioned bracket 2 are provided on both sides of these head holes 4*a*, respectively (see FIG. 10(*a*)).

Moreover, in a state where an outer surface of the first lateral wall part 2*b* is in contact with its corresponding reference surface of the block frame 4 in the X-axis direction and an outer surface of the second wall part 2*a* is in contact with its corresponding reference surface of the block frame 4 in the Y-axis direction, the first and second bracket holes 2*b*1 and 2*c*1 and the block frame screw holes 4*b* provided in the block frame 4 are fixed to each other using screws, whereby the bracket 2 is fixed in position with respect to the block frame 4. This causes the bracket 2 and the block frame 4 to become integrated with each other.

It should be noted that the position of the nozzle surface of each of the head sections 1 attached to the block frame 4 is slightly higher than the position of a lower surface of the block frame 4. This makes it possible to prevent the nozzle surface from making contact with a recording medium.

In the line head 6, the head position adjustment mechanisms 100 to which the first head sections 61 have been attached are attached to the block frame 4 after the initial positioning of the head sections 1 through the adjustment of the positions of the head fixing sections 3 in the X-axis direction with respect to the brackets 2 with the use of jigs (pins) or the like.

Specifically, the initial positioning is performed by putting a pair of circular holes P2 (see FIG. 4(*b*)), which are provided in the second wall part 2*a* of each of the brackets 2, over a pair of long holes P1 (see FIG. 3(*b*)), which are provided in the first wall part 3*c* of each of the head fixing section 3, and inserting jigs Q through the pair of long holes P1 and the pair of circular holes P2 (see FIG. 1(*b*)).

Moreover, the nozzle positions of the first head sections 61 are adjusted by their respective head position adjustment mechanisms 100 to be proper positions with respect to the nozzle positions of the second head sections 62 serving as references.

This makes it possible to easily adjust the positions of the first head sections 61 in a longitudinal direction (X-axis direction) with respect to the second head sections 62 with a high degree of accuracy.

In this state, the line head 6 are attached to a recording section (not illustrated) of an inkjet recording apparatus. At this point in time, the line head 6 is positioned with respect to the recording section by fitting a fulcrum pin hole 41 over a fulcrum pin (not illustrated) provided on the recording section and bringing a U-shaped hole 42 into contact with a turning device (not illustrated) provided in the recording section. The fulcrum pin hole 41 is provided at a first end of the line head 6. The U-shaped hole 42 is provided at a second end of the line head 6.

Further, the line head 6 is also configured such that the position of the line head 6 can be adjusted by the turning device.

The foregoing has described an embodiment of the present invention. However, the present invention is not limited to this embodiment.

A head position adjustment mechanism 100 according to the present embodiment is not only used for a line recording head but can also be employed for a serial recording head.

Although, in the head position adjustment mechanism 100 according to the present embodiment, the first and second flange parts 13 and 14 of the head section 1 are positioned by being brought into contact with the positioning pins 33 and 34 of the head fixing section 3, this is not the only positioning method.

Although, in the head position adjustment mechanism 100 according to the present embodiment, four slide unit sections 51 are fixedly attached to the first groove portions 31 outside the first wall part 3*c* of the head fixing section using screws, it is not necessarily essential to provide the first groove portions 31. For example, the upper supporting surfaces 31*b* may be replaced by positioning pins, provided on the first wall part 3*c* of the head fixing section, which are brought into contact with the upper surfaces 51*a* of the slide unit sections 51.

Further, the number of slide unit sections 51 is not limited to this.

Further, the first wall part 3*c* and the slide unit sections 51 may be integrally formed.

Similarly, although a pair of track rail sections 52 extending in a linear fashion are fixedly attached to the second groove portions 21 inside the second wall part 2*a* of the bracket 2 using screws, it is not necessarily essential to provide the second groove portions 21. For example, the lower supporting surfaces 21*b* may be replaced by positioning pins, provided on the second wall part 2*a* of the bracket 2, which are brought into contact with the lower surfaces 52*a* of the track rail sections 52.

Further, the number of track rail sections 52 is not limited to this, either.

Further, the second wall part 2*a* and the track rail sections 52 may be integrally formed.

Although, in the head position adjustment mechanism 100 according to the present embodiment, the slide unit sections 51 are attached to the outer side of the first wall part 3*c* of the head fixing section 3 and the track rail sections 52 are attached to the inner side of the second wall part 2*a* of the bracket 2, the opposite may be the case. That is, the track rail sections 52 may be attached to the outer side of the first wall part 3*c* of the head fixing section 3 and the slide unit sections 51 may be attached to the inner side of the second wall part 2*a* of the bracket 2.

Although, in the head position adjustment mechanism 100 according to the present embodiment, the linear-motion mechanism 5 (linear guide) used include slide unit sections 51 and track rail sections 52 on which the slide unit sections 51 are slidable, this does not imply any limitation. It is alternatively possible to employ a combination of shafts and linear bearings, a combination of linear spline shafts and linear bearings, or the like.

Although, in the head position adjustment mechanism 100 according to the present embodiment, the connecting plate 32 having the inclined contact surface 32*a* is fixedly attached to the upper side of the first side end of the first wall part 3*c* in the X-axis direction, the position in which the connecting plate 32 is fixed is not limited to a particular position.

Further, the connecting plate 32 and the first wall part 3*c* may be integrally formed.

Although, in the head position adjustment mechanism 100 according to the present embodiment, the coupling part 24 for attachment of the tapered pin 22 is attached to the upper side of the corner formed by the first wall part 2*a* and the first lateral wall part 2*b* of the bracket 2, the position of attachment of the coupling part 24 is not limited to a particular position.

Further, the bracket 2 and the coupling part 24 may be integrally formed.

Although, in the head position adjustment mechanism 100 according to the present embodiment, the tapered pin 22 includes the head part 22*a*, the upper support 22*b*1, the screw part 22*c*, the lower support 22*b*, and the tapered part 22*d*, the tapered pin 22 is not limited to this structure, provided the tapered pin 22 includes the tapered part 22*d*.

The head position adjustment mechanism 100 according to the present embodiment may further include an electric actuator (not illustrated) or an electric motor (not illustrated) for turning the tapered pin 22.

In this case, it is possible to drive, in accordance with an external signal, and rotate the tapered pin 22 by a designated amount with a higher degree of accuracy.

Further, it is also possible to recognize the degree of rotation of the tapered pin 22 with a higher degree of accuracy.

Although, in the head position adjustment mechanism 100 according to the present embodiment, the plunger 23 includes the box part 23*a*, the biasing spring part 23*b*, and the ball part 23*c*, the plunger 23 is not limited to this structure, provided the plunger 23 has a unidirectional biasing capability.

The block frame 4 shown in FIG. 10(*a*) is not the only example of a block frame to which head position adjustment mechanisms 100 according to the present embodiment are to be attached.

Each of FIGS. 11(*a*), (*b*), (*c*), and (*d*) is a schematic top view showing another example of a block frame to which head position adjustment mechanisms according to the present embodiment are to be attached.

As shown in FIG. 11(*a*), a block frame 43 may include an arrangement of a row of three head holes 4*a* next to one another and a row of two head holes 4*a* next to each other.

Further, as shown in FIG. 11(*b*), a block frame 44 may include an arrangement of two rows of three head holes 4*a* next to one another and two rows of two head holes 4*a* next to each other.

Further, as shown in FIG. 11(*c*), a block frame 45 may include an oblique arrangement of six head holes 4*a*. It should be noted that, in this case, although the cross direction of a fed recording medium and the X-axis direction of the head sections do not agree, the positions of dots of ink that are applied to the recording medium are adjusted in the cross direction of the recording medium by moving the head sections in the X-axis direction.

Further, as shown in FIG. 11(*d*), a block frame 46 may be provided with one head hole 4*a*.

INDUSTRIAL APPLICABILITY

A head position adjustment mechanism of the present invention is applicable as a mechanism for adjusting the position of a head section of an inkjet recording apparatus having a plurality of head sections.

The head position adjustment mechanism of the present invention makes it possible to easily adjust the position of a head section in a longitudinal direction (X-axis direction) with a high degree of accuracy.

REFERENCE SIGNS LIST

1 . . . Head section
10 . . . Body part
100 . . . Head position adjustment mechanism
11 . . . Ink inlet
12 . . . Ink outlet
13 . . . First flange part
13*a* . . . First head section hole
14 . . . Second flange part
14*a* . . . Second head section hole
15 . . . Nozzle plate
16 . . . Supporting base
2 . . . Bracket
21 . . . Second groove portion (groove portion of bracket)
21*a* . . . Screw hole
21*b* . . . Lower supporting surface
21*c* . . . Attaching and fixing surface
22 . . . Tapered pin
22*a* . . . Head part
22*b*1 . . . Upper support
22*b*2 . . . Lower support
22*c* . . . Screw part
22*d* . . . Tapered part
22*e* . . . Pressure spring part
23 . . . Plunger
23*a* . . . Box part
23*a*1 . . . Vent hole
23*b* . . . Biasing spring part
23*c* . . . Ball part
24 . . . Coupling part
24*a* . . . Thread part
24*b*1 . . . Upper guide
24*b*2 . . . Lower guide
2*a* . . . Second wall part (wall part of bracket)
2*b* . . . First lateral wall part
2*b*1 . . . First bracket hole
2*c* . . . Second lateral wall part
2*c*1 . . . Second bracket hole
3 . . . Head fixing section
31 . . . First groove portion (groove portion of head fixing section)
31*a* . . . Hole
31*b* . . . Upper supporting surface
31*c*, 52*b* . . . Screw

32 . . . Connecting plate
32*a* . . . Contact surface
33 . . . First positioning pin (positioning pin)
33*a* . . . First head fixing section screw hole
34 . . . Second positioning pin (positioning pin)
34*a* . . . Second head fixing section screw hole
3*a* . . . Supporting plate part
3*a*1, 3*a*2 . . . Step
3*b* . . . Void part
3*c* . . . First wall part (wall part of head fixing section)
4, 43, 44, 45, 46 . . . Block frame
41 . . . Fulcrum pin hole
42 . . . U-shaped hole
4*a* . . . Head hole
4*a*1 . . . Reference head hole (head hole)
4*b*, 4*d* . . . Block frame screw hole
4*c* . . . Positioning pin
5 . . . Linear-motion mechanism
51 . . . Slide unit section
51*a* . . . Upper surface
52 . . . Track rail section
52*a* . . . Lower surface
6 . . . Line head
61 . . . First head section
62 . . . Second head section
P1 . . . Long hole
P2 . . . Circular hole
Q . . . Jig

The invention claimed is:

1. An inkjet recording apparatus comprising a head position adjustment mechanism for adjusting a position of a head section of the inkjet recording apparatus and a plurality of head sections in an X-axis direction that is a longitudinal direction of each of the head sections, the head position adjustment mechanism comprising:

a head fixing section for fixedly supporting the head section and having a rectangular shape in a top view;

a linear-motion mechanism to which the head fixing section has been attached; and a bracket to which the linear-motion mechanism has been attached, the head position adjustment mechanism being attached to at least one of the head sections, wherein the linear-motion mechanism serves to guide the head fixing section in the X-axis direction with respect to the bracket, the bracket has a tapered pin and a plunger attached thereto, the tapered pin having a tapered part, the plunger having a unidirectional biasing function, the tapered pin and the plunger facing each other, the tapered pin has its tapered part brought into contact with a first side end of the head fixing section in the X-axis direction, the plunger biases a second side end of the head fixing section in the X-axis direction toward the tapered pin, moving the tapered pin up and down causes the head fixing section to linearly move in the X-axis direction so that a position of the head fixing section is adjusted, the linear-motion mechanism includes a slide unit section and a track rail section on which the slide unit section is slidable, the slide unit section is attached to the head fixing section, and the track rail section is attached to the bracket.

2. The inkjet recording apparatus according to claim 1, wherein the head fixing section has a connecting plate provided at the first side end of the head fixing section in the X-axis direction, and the tapered pin has its tapered part brought into contact with the connecting plate.

3. The inkjet recording apparatus according to claim 2, wherein the head section is a line recording head having a nozzle formed in a lower surface thereof.

4. The inkjet recording apparatus according to claim 2, wherein a line head comprises:

a first head section obtained by attaching the head position adjustment mechanism to the head section;

a second head section obtained by not attaching the head position adjustment mechanism to the head section; and a block frame to which the first head section and the second head section have been attached.

5. The inkjet recording apparatus according to claim 1, wherein the tapered pin is screwed to the bracket.

6. The inkjet recording apparatus according to claim 5, wherein the head position adjustment mechanism, further comprises an electric actuator or an electric motor for turning the tapered pin.

7. The inkjet recording apparatus according to claim 6, wherein the head section is a line recording head having a nozzle formed in a lower surface thereof.

8. The inkjet recording apparatus according to claim 6, wherein a line head comprises:

a first head section obtained by attaching the head position adjustment mechanism to the head section;

a second head section obtained by not attaching the head position adjustment mechanism to the head section; and a block frame to which the first head section and the second head section have been attached.

9. The inkjet recording apparatus according to claim 5, wherein the head section is a line recording head having a nozzle formed in a lower surface thereof.

10. The inkjet recording apparatus according to claim 5, wherein a line head comprises:

a first head section obtained by attaching the head position adjustment mechanism to the head section;

a second head section obtained by not attaching the head position adjustment mechanism to the head section; and a block frame to which the first head section and the second head section have been attached.

11. The inkjet recording apparatus according to claim 1, wherein the head section is a line recording head having a nozzle formed in a lower surface thereof.

12. The inkjet recording apparatus of claim 1, additionally comprising a line head comprising:

a first head section obtained by attaching the head position adjustment mechanism to the head section;

a second head section obtained by not attaching the head position adjustment mechanism to the head section; and a block frame to which the first head section and the second head section have been attached.

13. An inkjet recording apparatus comprising a head position adjustment mechanism for adjusting a position of a head section of the inkjet recording apparatus and a plurality of head sections in an X-axis direction that is a longitudinal direction of each of the head sections, the head position adjustment mechanism comprising:

a head fixing section for fixedly supporting the head section and having a rectangular shape in a top view;

a linear-motion mechanism to which the head fixing section has been attached; and a bracket to which the linear-motion mechanism has been attached, the head position adjustment mechanism being attached to at least one of the head sections, wherein the linear-motion mechanism serves to guide the head fixing section in the X-axis direction with respect to the bracket, the bracket has a tapered pin and a plunger attached thereto, the tapered pin having a tapered part, the plunger having a unidirectional biasing function, the tapered pin and the plunger facing each other, the tapered pin has its tapered part brought into contact with a first side end of the head fixing section in the X-axis direction, the plunger biases a second side end of the head fixing section in the X-axis direction toward the tapered pin, moving the tapered pin up and down causes the head fixing section to linearly move in the X-axis direction so that a position of the head fixing section is adjusted, wherein the head section has a first flange part provided at a first side end of the head section in the X-axis direction and a second flange part provided at a second side end of the head section in the X-axis direction, the first flange part being provided with a notch having a V shape in a top view, the second flange part having an L shape in a top view, the head fixing section has a pair of positioning pins provided on both sides, respectively, of the head fixing section, and the head section is fixedly supported by the head fixing section by fixing the first flange part and the second flange part using screws in a state where the first flange part and the second flange part are in contact with their corresponding ones of the positioning pins, respectively.

14. The inkjet recording apparatus according to claim 13, wherein the head fixing section has a connecting plate provided at the first side end of the head fixing section in the X-axis direction, and the tapered pin has its tapered part brought into contact with the connecting plate.

15. The inkjet recording apparatus according to claim 13, wherein the tapered pin is screwed to the bracket.

16. The inkjet recording apparatus according to claim 13, wherein the head section is a line recording head having a nozzle formed in a lower surface thereof.

17. The inkjet recording apparatus of claim 13, wherein a line head comprises:

a first head section obtained by attaching the head position adjustment mechanism to the head section;

a second head section obtained by not attaching the head position adjustment mechanism to the head section; and a block frame to which the first head section and the second head section have been attached.

18. An inkjet recording apparatus comprising a head position adjustment mechanism for adjusting a position of a head section of the inkjet recording apparatus and a plurality of head sections in an X-axis direction that is a longitudinal direction of each of the head sections, the head position adjustment mechanism comprising:

a head fixing section for fixedly supporting the head section and having a rectangular shape in a top view;

a linear-motion mechanism to which the head fixing section has been attached; and a bracket to which the linear-motion mechanism has been attached, the head position adjustment mechanism being attached to at least one of the head sections, wherein the linear-motion mechanism serves to guide the head fixing section in the X-axis direction with respect to the bracket, the bracket has a tapered pin and a plunger attached thereto, the tapered pin having a tapered part, the plunger having a unidirectional biasing function, the tapered pin and the plunger facing each other, the tapered pin has its tapered part brought into contact with a first side end of the head fixing section in the X-axis direction, the plunger biases a second side end of the head fixing section in the X-axis direction toward the tapered pin, moving the tapered pin up and down causes the head fixing section to linearly move in the X-axis direction so that a position of the head fixing section is adjusted, the head fixing section has a connecting plate provided at the first side end of the head fixing section in the X-axis direction, the tapered pin has its tapered part brought into contact with the connecting plate, the tapered pin is screwed to the bracket, the linear-motion mechanism includes a slide unit section and a track rail section on which the slide unit section is slidable, the slide unit section is attached to the head fixing section, and the track rail section is attached to the bracket.

19. The inkjet recording apparatus of claim 18, wherein the head position adjustment mechanism further comprises an electric actuator or an electric motor for turning the tapered pin.

20. The inkjet recording apparatus according to claim 18, wherein the head section is a line recording head having a nozzle formed in a lower surface thereof.

21. The inkjet recording apparatus according to claim 18, wherein a line head comprises:

a first head section obtained by attaching the head position adjustment mechanism to a head section;

a second head section obtained by not attaching the head position adjustment mechanism to a head section; and a block frame to which the first head section and the second head section have been attached.

22. An inkjet recording apparatus comprising a head position adjustment mechanism for adjusting a position of a head section of the inkjet recording apparatus and a plurality of head sections in an X-axis direction that is a longitudinal direction of each of the head sections, the head position adjustment mechanism comprising:

a head fixing section for fixedly supporting the head section and having a rectangular shape in a top view;

a linear-motion mechanism to which the head fixing section has been attached; and a bracket to which the linear-motion mechanism has been attached, the head position adjustment mechanism being attached to at least one of the head sections, wherein the linear-motion mechanism serves to guide the head fixing section in the X-axis direction with respect to the bracket, the bracket has a tapered pin and a plunger attached thereto, the tapered pin having a tapered part, the plunger having a unidirectional biasing function, the tapered pin and the plunger facing each other, the tapered pin has its tapered part brought into contact with a first side end of the head fixing section in the X-axis direction, The plunger biases a second side end of the head fixing section in the X-axis direction toward the tapered pin, moving the tapered pin up and down causes the head fixing section to linearly move in the X-axis direction so that a position of the head fixing section is adjusted, the head fixing section has a connecting plate provided at the first side end of the head fixing section in the X-axis direction, the tapered pin has its tapered part brought into contact with the connecting plate, the tapered pin is screwed to the bracket, the head section has a first flange part provided at a first side end of the head section in the X-axis direction and a second flange part provided at a second side end of the head section in the X-axis direction, the first flange part being provided with a notch having a V shape in a top view, the second flange part having an L shape in a top view, the head fixing section has a pair of positioning pins provided on both sides, respectively, of the head fixing section, and the head section is fixedly supported by the head fixing section by fixing the first flange part and the second flange part using screws in a state where the first flange part and the second flange part are in contact with their corresponding ones of the positioning pins, respectively.

23. The inkjet recording apparatus of claim 22, wherein the head position adjustment mechanism further comprises an electric actuator or an electric motor for turning the tapered pin.

24. The inkjet recording apparatus according to claim 22, wherein the head section is a line recording head having a nozzle formed in a lower surface thereof.

25. The inkjet recording apparatus according to claim 22, wherein a line head comprises:

a first head section obtained by attaching the head position adjustment mechanism to a head section;

a second head section obtained by not attaching the head position adjustment mechanism to a head section; and a block frame to which the first head section and the second head section have been attached.

* * * * *